US012089662B2

(12) United States Patent
Hamilton

(10) Patent No.: US 12,089,662 B2
(45) Date of Patent: Sep. 17, 2024

(54) ADJUSTABLE BRA INSERT AND METHOD OF USING SAME

(71) Applicant: L & S Warriors, LLC, Alpharetta, GA (US)

(72) Inventor: Lillian D. Hamilton, Kennesaw, GA (US)

(73) Assignee: L&S Warriors, LLC, Alpharetta, GA (US)

( * ) Notice: Subject to any disclaimer, the term of this patent is extended or adjusted under 35 U.S.C. 154(b) by 22 days.

(21) Appl. No.: 18/184,048

(22) Filed: Mar. 15, 2023

(65) Prior Publication Data

US 2024/0016236 A1 Jan. 18, 2024

Related U.S. Application Data

(60) Provisional application No. 63/389,750, filed on Jul. 15, 2022.

(51) Int. Cl.
*A41C 3/10* (2006.01)
*A41C 3/14* (2006.01)

(52) U.S. Cl.
CPC ..... *A41C 3/10* (2013.01); *A41C 3/142* (2013.01)

(58) Field of Classification Search
CPC ..... A41C 3/10
USPC ..... 450/55, 54
See application file for complete search history.

(56) References Cited

U.S. PATENT DOCUMENTS

| | | | | |
|---|---|---|---|---|
| 3,067,431 | A | 12/1962 | Kausch | |
| 3,293,663 | A | 12/1966 | Cronin | |
| 4,701,230 | A | 10/1987 | Loi | |
| D492,089 | S * | 6/2004 | Flannery | D2/706 |
| 7,776,019 | B2 * | 8/2010 | Kawakami | A61F 13/141 604/385.07 |
| D894,529 | S | 9/2020 | Henderson | |
| 2012/0083863 | A1 | 4/2012 | Gillespie | |
| 2021/0112885 | A1 * | 4/2021 | Hunt | A41C 3/04 |

OTHER PUBLICATIONS

International Search Report and Written Opinion for corresponding International Application No. PCT/US2023/026703 dated Oct. 10, 2023, 10 pages.

Website page showing Nearly Me Forms retrieved from http://web.archive.org with URL: https://www.healthproductsforyou.com/p-nearly-me-420-casual-non-weighted-symmetrical-modified-triangle-foam-breast-form.html, available on Sep. 12, 2015, 1 page.

* cited by examiner

*Primary Examiner* — Gloria M Hale
(74) *Attorney, Agent, or Firm* — Hoffman Warnick LLC

(57) ABSTRACT

A bra insert and a method of using the bra insert is provided. The bra insert includes a first end; a second end opposite the first end; a sleeve configured to extend between the first end and the second end along a longitudinal axis, the sleeve including an adjustable portion for receiving a fillable material therein; and a slit on an outer surface of the sleeve, the slit sized to receive at least a portion of the adjustable portion therethrough.

20 Claims, 4 Drawing Sheets

ADJUSTABLE BRA INSERT AND METHOD OF USING SAME

CROSS REFERENCE TO RELATED APPLICATIONS

This application claims the benefit of U.S. provisional application No. 63/389,750, filed Jul. 15, 2022, the content of which is incorporated by reference in its entirely herein.

FIELD

The disclosure relates generally to a bra insert and a method of using the same. More particularly, the disclosure relates to a bra insert that is adjustable and a method of using the bra insert under a bra of a user.

BACKGROUND

Existing bra inserts, especially bra inserts used to fill out a bra for post-mastectomy surgery patients, have many shortcomings. For example, conventional bra inserts usually need to be individually "custom fitted" to a bra of a user and are not adjustable by the user to a desired shape or size. The conventional bra inserts could be heavy and uncomfortable for the user, potentially hot against skin of the user. They are cumbersome for the user to insert into an apparel. In addition, conventional bra inserts do not allow stuffing or fillable materials to be easily added or removed by the user without using conventional fasteners (e.g., buttons, VELCRO®, snaps, etc.). In order to allow the conventional bras to be inserted into a bra of the user, the bra is required to contain a pre-defined interior pocket. Therefore, such conventional bra inserts are not easily adjustable, and are inconvenient or uncomfortable to use.

BRIEF DESCRIPTION

All aspects, examples and features mentioned below can be combined in any technically possible way.

An aspect of the disclosure provides a bra insert comprising: a first end; a second end opposite the first end; a sleeve configured to extend between the first end and the second end along a longitudinal axis, the sleeve including an adjustable portion for receiving a fillable material therein; and a slit on an outer surface of the sleeve, the slit sized to receive at least a portion of the adjustable portion therethrough.

Another aspect of the disclosure includes the preceding aspects, and where the bra insert further comprises a flap extending radially from an underside of the sleeve.

Another aspect of the disclosure includes any of the preceding aspects, and where the flap is configured to be positioned between an underside of a bra of an user and skin of the user, therefore securing the bra insert under the bra.

Another aspect of the disclosure includes any of the preceding aspects, and where the slit extends vertically on the outer surface of the sleeve.

Another aspect of the disclosure includes any of the preceding aspects, and where the slit is adjacent to one of the first and second ends, and the adjustable portion is adjacent to the other one of the first and second ends.

Another aspect of the disclosure includes any of the preceding aspects, and where the adjustable portion is configured to receive the fillable material through the slit.

Another aspect of the disclosure includes any of the preceding aspects, and where the adjustable portion is configured to be in an extended form in which an upper or a lower surface of the adjustable portion extends along the longitudinal axis, when the adjustable portion is free of the fillable material.

Another aspect of the disclosure includes any of the preceding aspects, and where the adjustable portion is configured to twist relative to a portion of the sleeve that includes the slit about a folding point, after the fillable material is received inside the adjustable portion.

Another aspect of the disclosure includes any of the preceding aspects, and where the adjustable portion is configured to be in a wearable form in which at least a portion of an outer surface of the adjustable portion is inserted through the slit and abuts one of the first and second ends proximate the slit.

Another aspect of the disclosure includes any of the preceding aspects, and where an amount of the fillable material received in the adjustable portion is adjustable to conform a shape of the bra insert to a shape of the bra of the user.

An aspect of the disclosure provides a bra insert comprising: a first end; a second end opposite the first end; a sleeve including an adjustable portion for receiving a fillable material therein; and a slit on a surface of the sleeve, wherein the bra insert is adjustable between: an extended form where the sleeve extends between the first end and the second end along a longitudinal axis; and a wearable form where at least a portion of an outer surface of the adjustable portion is inserted through the slit and abuts one of the first and second ends proximate the slit.

Another aspect of the disclosure includes the preceding aspects, and where the bra insert further comprises a flap extending radially from an underside of the sleeve.

Another aspect of the disclosure includes any of the preceding aspects, and where the slit extends vertically on the outer surface of the sleeve.

Another aspect of the disclosure includes any of the preceding aspects, and where the adjustable portion is configured to receive the fillable material through the slit.

Another aspect of the disclosure includes any of the preceding aspects, and where in the extended form, an upper or a lower surface of the adjustable portion extends along the longitudinal axis, and the adjustable portion is free of the fillable material.

An aspect of the disclosure provides a method of using a bra insert under a bra of a user, comprising: providing the bra insert including: a first end, a second end opposite the first end, a sleeve including an adjustable portion for receiving a fillable material therein, and a slit on a surface of the sleeve; filling the adjustable portion with the fillable material through the slit; twisting the adjustable portion relative to a portion of the sleeve that includes the slit about a folding point; and inserting at least a portion of the adjustable portion through the slit.

Another aspect of the disclosure includes the preceding aspects, and where the bra insert further includes a flap, and the method further includes positioning the flap between an underside of the bra and skin of the user, therefore securing the bra insert under the bra.

Another aspect of the disclosure includes any of the preceding aspects, and where the slit is adjacent to one of the first and second ends, and the adjustable portion is adjacent to the other one of the first and second ends.

Another aspect of the disclosure includes any of the preceding aspects, and where the method further comprises adjusting an amount of the fillable material received in the adjustable portion to conform a shape of the bra insert to a shape of the bra of the user.

Another aspect of the disclosure includes any of the preceding aspects, and where the inserting further includes inserting at least a portion of an outer surface of the adjustable portion through the slit such that the portion of the outer surface of the adjustable portion abuts one of the first and second ends proximate the slit.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
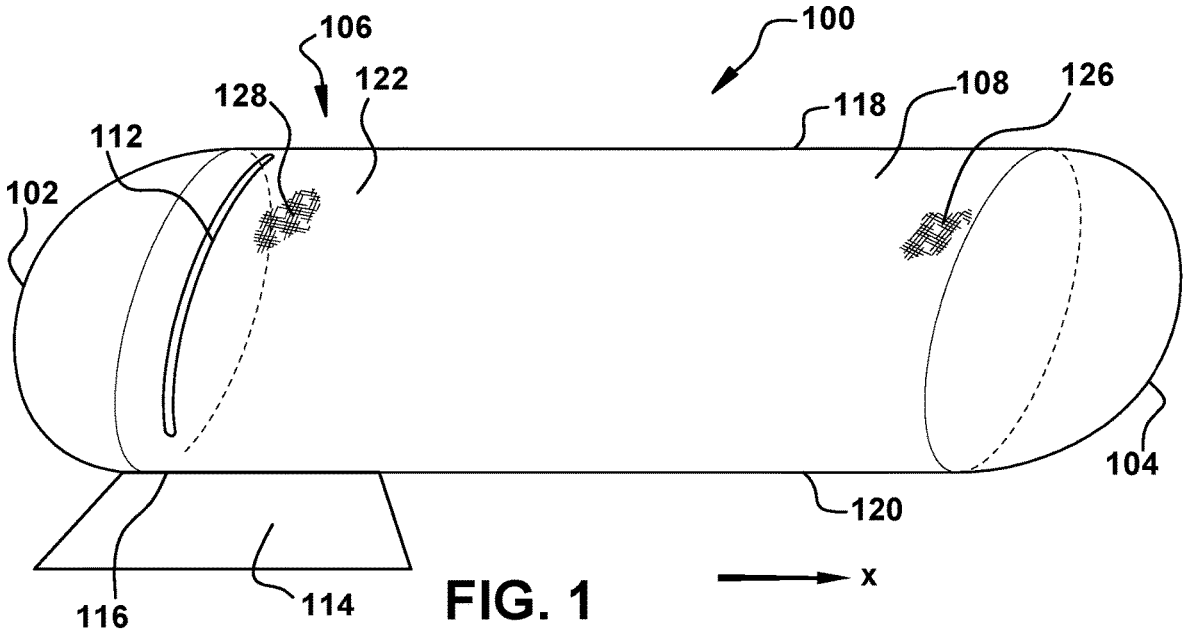
FIG. 1 is a perspective view of a bra insert, according to one embodiment of the current disclosure.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the subject matter of the current disclosure, it will become necessary to select certain terminology when referring to and describing relevant machine components within the current disclosure. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

The terms "first", "second", and "third" may be used interchangeably to distinguish one component from another and are not intended to signify location or importance of the individual components.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof "Optional" or "optionally" means that the subsequently described event or circumstance may or may not occur or that the subsequently describe component or element may or may not be present, and that the description includes instances where the event occurs or the component is present and instances where it does not or is not present.

Where an element or layer is referred to as being "on," "engaged to," "connected to" or "coupled to" another element or layer, it may be directly on, engaged to, connected to, or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/of" includes any and all combinations of one or more of the associated listed items.

As indicated above, existing bra inserts need to be individually "custom fitted," are not adjustable by the user to a required shape or size, are heavy and uncomfortable for the user, and/or are cumbersome for the user to insert into an apparel.

Embodiments of the current disclosure allows the user to add or remove fillable materials to/from the insert without using fasteners such as buckles, laces, VELCRO®, etc. It allows the user to easily adjust the shape or size of the bra insert to conform with any shapes and sizes of bras. The bra insert fits in a regular bra of the user and does not require a special pocket within the bra to contain a bra insert therein. The bra insert of the current disclosure is sealed via folding back on itself, resulting in a comfortable fit, smooth contour, lightweight, machine washable product that is easy to service and comfortable to wear. Additionally, the bra insert of the current disclosure may optionally include a flap, which allows the user to secure the bra insert into any exiting bra by securing the flap between the elastic strap below the bra cup and skin of the user.

FIG. 1 is a perspective view of a bra insert 100, according to one embodiment of the present disclosure. Bra insert 100 includes a first end 102; a second end 104 opposite first end 102; a sleeve 106 configured to extend between first and second ends 102, 104 along a longitudinal axis (in a direction "x" as shown in FIG. 1), the sleeve 106 including an adjustable portion 108 for receiving a stuffing or a fillable material (110, shown in FIG. 2) therein; and a slit 112 on an outer surface 128 (a portion of outer surface 128 is illustrated in a cross-stich pattern as a non-limiting example in FIG. 1) of sleeve 106. Slit 112 may be sized to receive at least a portion of adjustable portion 108.

Sleeve 106 may be made of a fabric that can stretch and is comfortable against skin of the user. In embodiments, sleeve 106 may extend between first and second ends 102, 104 along the longitudinal axis in a direction "x", and bra insert 100 is in an extended form. In embodiments, the shape of sleeve 106 in its extended form may be that of a straight tube sock, having the toes closed at both ends 102, 104. The material composition of sleeve 106 is any of a variety of materials that allow the material to stretch and expand as fillable material 110 is added to sleeve 106 to achieve a desirable shape or size. Therefore, in embodiments, bra insert 100 is provided as a universal size, which is adjustable to adopt to a shape or size of a bra of the user by adjusting the amount of fillable material in the adjustable portion.

Sleeve 106 may include adjustable portion 108 configured to receive fillable material 110 through slit 112. In embodiments, adjustable portion 108 is configured to be in an extended form in which an upper and a lower surface 118, 120 of adjustable portion 108 extends along the longitudinal axis (in direction "x"). In this configuration, bra insert 100 is also referred to as being in an extended form.

Figure 2:
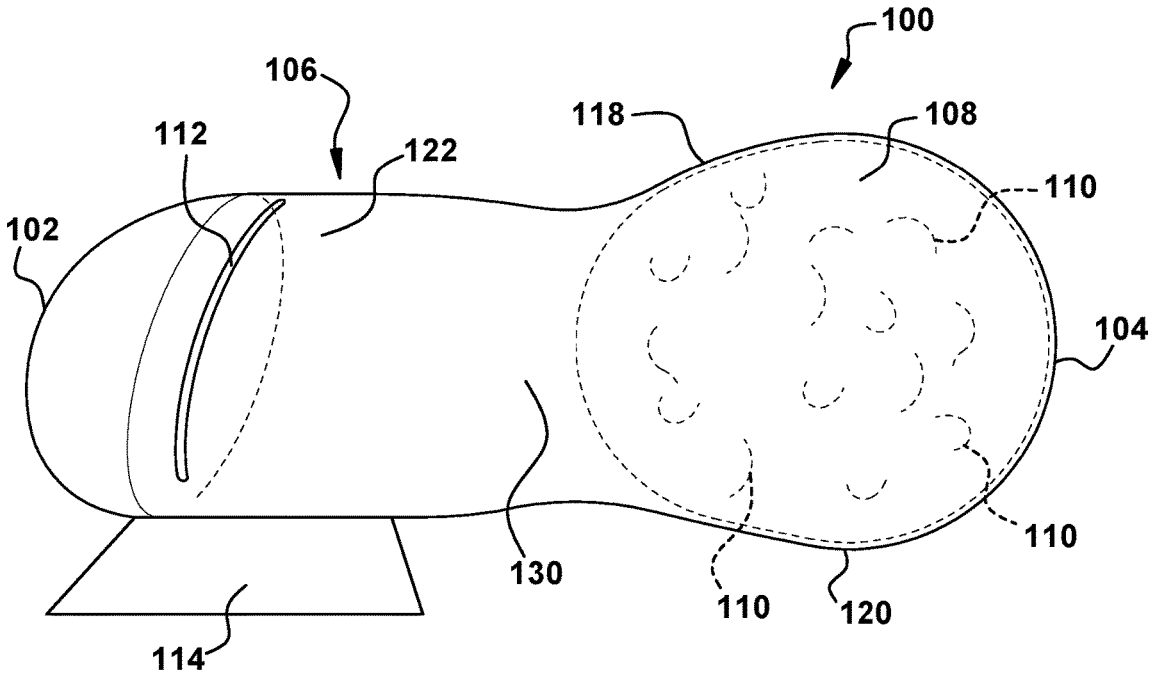
FIG. 2 is a perspective view of a bra insert, after a fillable material is added to an adjustable portion of the bra insert, according to one embodiment of the current disclosure.
Figure 3:
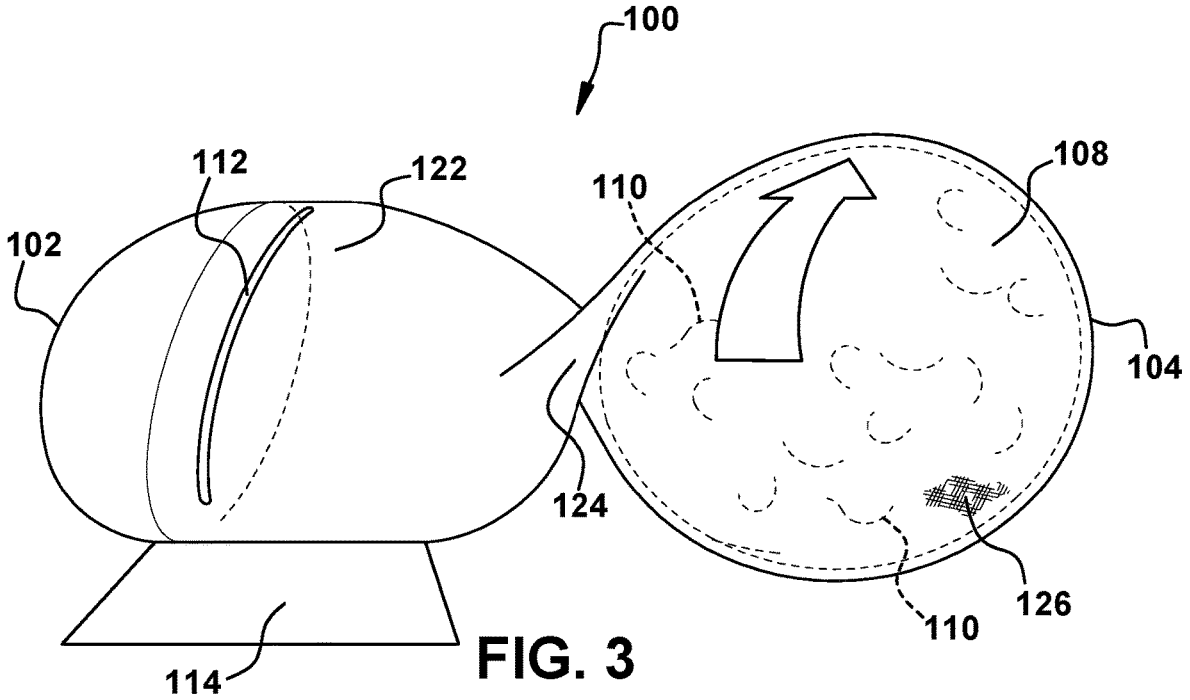
FIG. 3 is a perspective view of a bra insert, with the bra insert in a twisted form, according to one embodiment of the current disclosure.
Figure 5:
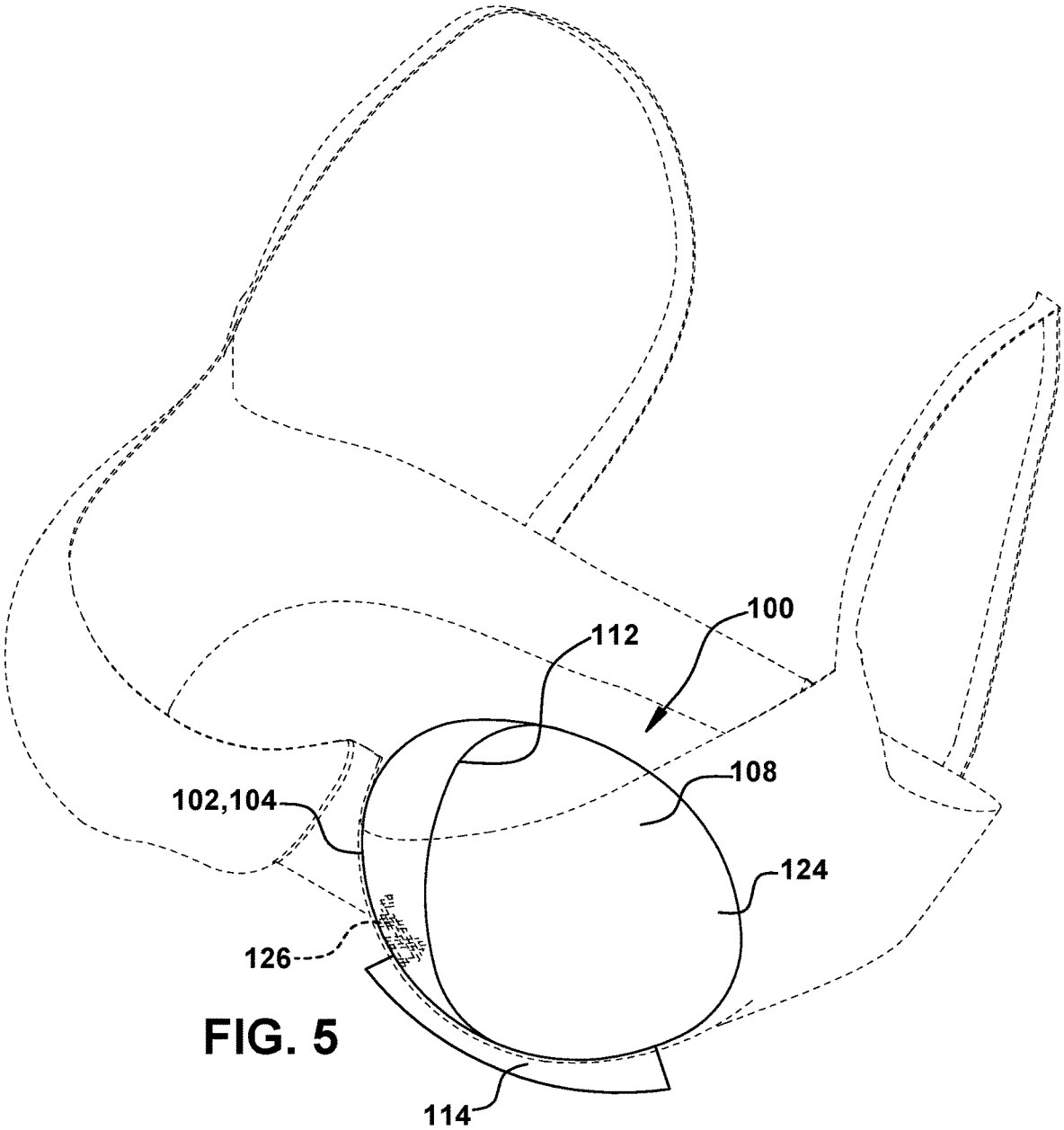
FIG. 5 is a perspective view of a bra insert, with the bra insert in a wearable form, according to one embodiment of the current disclosure.

As further described in detail herein, adjustable portion 108 and bra insert 100 including adjustable portion 108 can also be configured to be in a filled form, a twisted form, or a wearable form. In the filled form as illustrated in FIG. 2, fillable material 110 is received within adjustable portion 108. In a twisted form as illustrated in FIG. 3, adjustable portion 108 is configured to twist relative to a portion 122 of sleeve 106 that includes slit 112 about a folding point 124, after fillable material 110 is received inside adjustable portion 108. In a wearable form as illustrated in FIG. 5, at least a portion of outer surface 126 of adjustable portion 108 is inserted through slit 112 and abuts one of first and second ends 102, 104 proximate slit 112. Such various configurations of bra insert 100 including adjustable portion 108 allow bra insert 100 to receive fillable material 110 inside adjustable portion 108, and allow adjustable portion 108 to be twisted, folded back on itself and inserted through slit 112, to provide bra inserts with various advantages, as described herein.

In embodiments, slit 112 extends vertically on an outer surface 128 of sleeve 106. The outer surface 128 may be a circumferential outer surface 128 of sleeve 106. In certain embodiments, slit 112 is a vertical slit positioned approximately one third down the length of sleeve 106. In some embodiments, slit 112 is adjacent to one of the first and second ends 102, 104, and the adjustable portion is adjacent to the other one of the first and second ends 104, 102. It is to be understood that the positioning of slit 112 is not limited to what is illustrated in FIG. 1, rather, slit 112 may be placed in different positions on outer surface 128 of sleeve 106 to provide identical or similar functions.

Slit 112 may serve dual purposes. Slit 112 can be used to add or remove fillable material 110 to/from adjustable portion 108 of bra insert 100. This allows an amount of fillable material 110 received in adjustable portion 108 to be adjusted, thereby conforming a shape of bra insert 100 (when in a wearable form) to a shape of the bra of the user. Additionally, the same slit 112 can be used to secure bra insert 100 in its wearable form after adjustable portion 108 is filled with fillable material 110, twisted and folded back on itself, as described later.

In embodiments, bra insert 100 may optionally include a flap 114 extending radially from an underside 116 of sleeve 106. It is to be appreciated that the positioning of flap 114 is not limited to what is illustrated in FIG. 1, rather, flap 114 may be placed in different positions on sleeve 106 to provide identical or similar functions.

In use, flap 114 may be positioned between an underside of a bra of a user and skin of the user, therefore securing bra insert 100 to the bra of the user. For example, flap 114 may be placed between an existing elastic at the bottom of a bra cup and skin of the user.

FIG. 2 is a perspective view of bra insert 100 of FIG. 1, after fillable material 110 is added to adjustable portion 108 of bra insert 100.

Fillable material 110 is added to adjustable portion through slit 112 until a desirable amount is achieved. In this configuration, adjustable portion 108 is in a filled form. In embodiments, a joint area 130 is formed between adjustable portion 108 and portion 122 of sleeve 106 that includes slit 112.

Fillable material 110 may be any currently known or later developed materials suitable for filling bra insert 100 and compatible with materials of sleeve 106.

FIG. 3 is a perspective view of bra insert 100, with bra insert 100 in a twisted form.

Once fillable material 110 is added through slit 112 and received inside adjustable portion 108 as illustrated in FIG. 2, adjustable portion 108 may be twisted relative to portion 122 of sleeve 106 that includes slit 112 about a folding point 124. In this configuration, bra insert 100 is in a twisted form.

Figure 4:
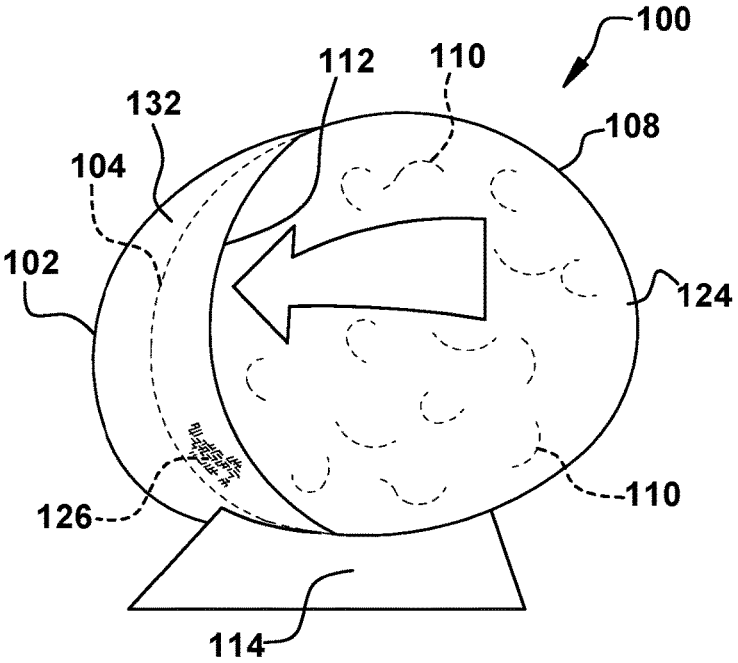
FIG. 4 is a perspective view of a bra insert, showing a portion of the adjustable portion folded back on itself and inserted through a slit, according to one embodiment of the current disclosure.

FIG. 4 is a perspective view of bra insert 100, showing a portion of adjustable portion 108 folded back on itself and inserted through slit 112.

After adjustable portion is twisted, as illustrated in FIG. 3, it is then folded back on itself and inserted through slit 112 and secured by slit 112. In this configuration, at least a portion of outer surface 126 (a portion of outer surface 126 is illustrated in a cross-stich pattern as a non-limiting example) of adjustable portion 108 is inserted through slit 112 and received inside sleeve 106. As illustrated in FIG. 4, when adjustable portion is folded back on itself, folding point 124 is positioned opposite first end 102. Folding point 124, along with first end 102, define the outermost ends of bra inset 100. In this compact form, portion of outer surface 126 of adjustable portion 108 is secured by slit 112 and positioned inside a cavity 132 under outer surface 122 of sleeve 106. Cavity 132 is between first end 102 and slit 112.

FIG. 5 is a perspective view of bra insert 100 in a wearable form.

In the wearable form, adjustable portion 108 is configured in which the portion of outer surface 126 of adjustable portion 108 is inserted through the slit and abuts one of the first and second ends proximate slit 112. In embodiments, in the wearable form, second end 104 abuts or overlaps with first end 102 proximate slit 112.

Referring to FIGS. 1 and 5 together, the current disclosure provides bra insert 100 that is adjustable between an extended form where sleeve 106 extends between first and second ends 102, 104 along a longitudinal axis (in a direction "x"), and a wearable form where at least a portion of outer surface 126 of adjustable portion 108 is inserted through slit 112 and abuts one of first and second ends 102, 104 proximate slit 112.

To use bra insert 100 in its wearable form, the user positions flap 114 between an underside of the bra and skin of the user, therefore securing bra insert 100 under the bra of the user.

Figure 6:
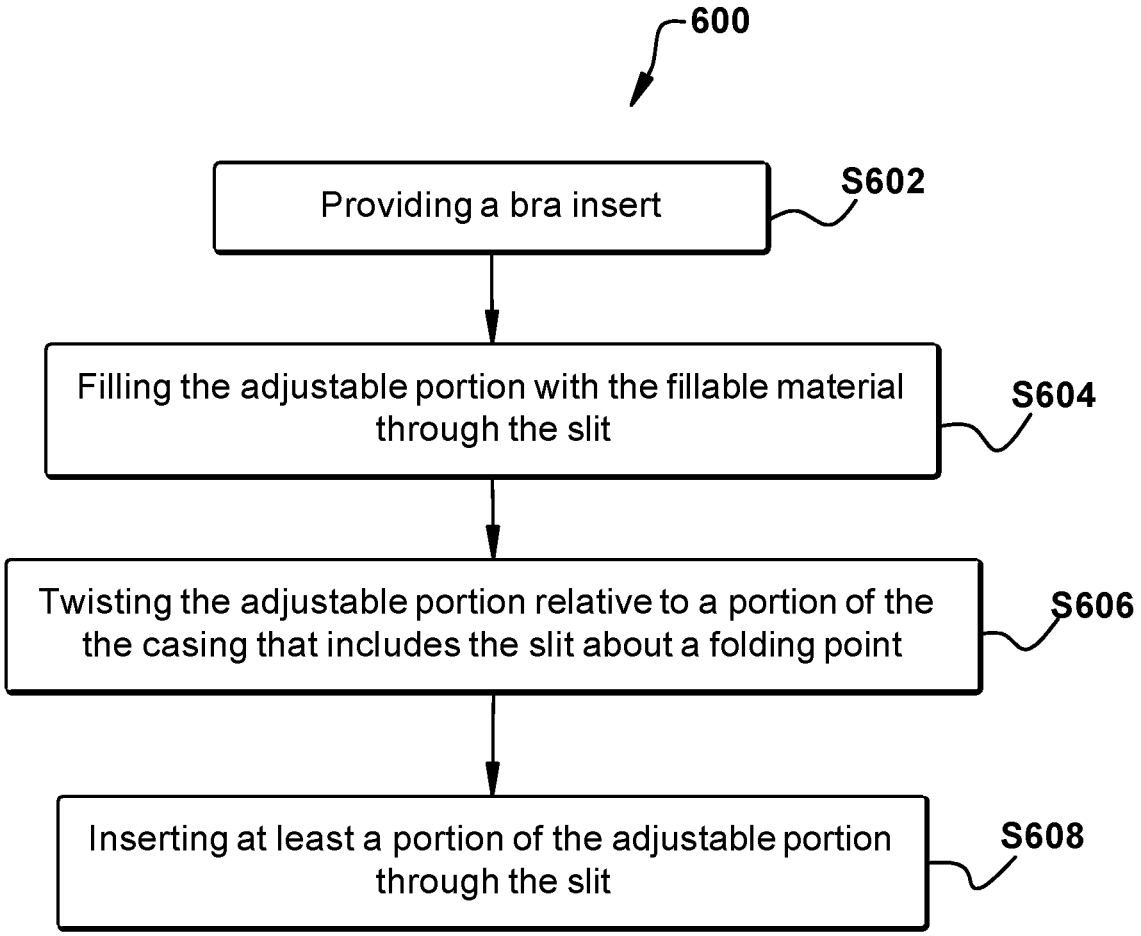
FIG. 6 is a flow diagram of a method of using a bra insert under a bra of a user, according to one embodiment of the current disclosure.

FIG. 6 is a flow diagram of a method of using bra insert 100 under a bra of a user. In step S602, a bra insert is provided. In a non-limiting embodiment, and with further reference to FIGS. 1-5, the bra insert may include: a first end 102; a second end 104 opposite first end 102; a sleeve 106 including an adjustable portion 108 for receiving a stuffing or a fillable material 110 therein; and a slit 112 on a surface of sleeve 106. The method may further include: filling adjustable portion 108 with fillable material 110 through slit 112 (S604); twisting adjustable portion 108 relative to a portion of sleeve 106 that includes slit 112 about a folding point 124 (S606); and inserting at least a portion of adjustable portion 108 through slit 112 (S608).

In embodiments, bra insert 100 may further include flap 114 extending radially from underside 116 of sleeve 106. The method may further include positioning flap 114 between an underside of a bra and skin of the user, therefore securing bra insert 100 to the bra of the user.

In embodiments, slit 112 is adjacent to one of first and second ends 102, 104, and adjustable portion 108 is adjacent to the other one of first and second ends 104, 102.

In embodiments, the method may include inserting at least a portion of outer surface 126 of adjustable portion 108 through slit 112 such that the portion of outer surface 126 of adjustable portion 108 abuts one of first and second ends 102, 104 proximate slit 112.

In embodiments, the method may further include adjusting an amount of fillable material 110 received in adjustable portion 108 to conform a shape of bra insert 100 to a shape of the bra of the user.

Embodiments of a bra insert of the current disclosure provides the user with an adjustable, smooth bra insert that is lightweight and comfortable to wear, without the need for conventional fasteners. Embodiments of the disclosure allow the user to adjust the amount of filling material inside the insert through a slit to provide a smooth contour of various shapes and sizes (depending on amounts of fillable material used), without the need to deal with conventional fasteners such as buckles, laces, VELCRO®, etc. This is important because the use of conventional fasteners may be felt by the user when wearing the bra insert, or alternatively, may disrupt the smooth contour of the bra including the bra insert as it appears through the users' clothing.

Furthermore, the adjustable portion of the bra insert, after being filled with desirable amount of fillable material, can be twisted and folded back on itself terminating under the slit that fastens the sleeve to keep the fillable material contained (without the need to a conventional fastener). This results in a comfortable fit, smooth contour, lightweight, machine washable unit that is easy to service and comfortable to wear.

Moreover, the bra insert of the current disclosure includes a flap that is configured to secure the insert against the user's skin using the existing elastic on the underside of any existing bra of the user's bra.

The foregoing drawings show some of the processing associated according to several embodiments of this disclosure. In this regard, each drawing or block within a flow diagram of the drawings represents a process associated with embodiments of the method described. It should also be noted that in some alternative implementations, the acts noted in the drawings or blocks may occur out of the order noted in the figure or, for example, may in fact be executed substantially concurrently or in the reverse order, depending upon the act involved. Also, one of ordinary skill in the art will recognize that additional blocks that describe the processing may be added.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "About," "approximately," and "substantially," as applied to a particular value of a range, applies to both end values and, unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application and to enable others of ordinary skill in the art to understand the disclosure for various embodiments with various modifications as are suited to the particular use contemplated.

What is claimed is:

1. A bra insert comprising:

a first end;

a second end opposite the first end;

a sleeve configured to extend between the first end and the second end along a longitudinal axis, the sleeve including an adjustable portion for receiving a fillable material therein; and a slit on an outer surface of the sleeve, the slit sized to receive at least a portion of the adjustable portion therethrough, wherein the adjustable portion is configured to twist relative to a portion of the sleeve that includes the slit about a folding point, after the fillable material is received inside the adjustable portion.

2. The bra insert of claim 1, further comprising a flap extending radially from an underside of the sleeve.

3. The bra insert of claim 2, wherein the flap is configured to be positioned between an underside of a bra of an user and skin of the user, therefore securing the bra insert under the bra.

4. The bra insert of claim 1, wherein the slit extends vertically on the outer surface of the sleeve.

5. The bra insert of claim 1, wherein the slit is adjacent to one of a first and second ends, and the adjustable portion is adjacent to the other one of the first and second ends.

6. The bra insert of claim 1, wherein the adjustable portion is configured to receive the fillable material through the slit.

7. The bra insert of claim 1, wherein the adjustable portion is configured to be in an extended form in which an upper or a lower surface of the adjustable portion extends along the longitudinal axis, when the adjustable portion is free of the fillable material.

8. The bra insert of claim 1, wherein the adjustable portion is configured to be in a wearable form in which at least a portion of an outer surface of the adjustable portion is inserted through the slit and abuts one of the first and second ends proximate the slit.

9. The bra insert of claim 1, wherein an amount of the fillable material received in the adjustable portion is adjustable to conform a shape of the bra insert to a shape of a bra of a user.

10. A bra insert comprising:

a first end;

a second end opposite the first end;

a sleeve including an adjustable portion for receiving a fillable material therein; and a slit on a surface of the sleeve, wherein the bra insert is adjustable between:

an extended form where the sleeve extends between the first end and the second end along a longitudinal axis; and a wearable form where at least a portion of an outer surface of the adjustable portion is inserted through the slit and abuts one of the first and second ends proximate the slit.

11. The bra insert of claim 10, further comprising a flap extending radially from an underside of the sleeve.

12. The bra insert of claim 10, wherein the slit extends vertically on the outer surface of the sleeve.

13. The bra insert of claim 10, wherein the adjustable portion is configured to receive the fillable material through the slit.

14. The bra insert of claim 10, wherein in the extended form, an upper or a lower surface of the adjustable portion extends along the longitudinal axis, and the adjustable portion is free of the fillable material.

15. A method of using a bra insert under a bra of a user, comprising:

providing the bra insert including:

a first end, a second end opposite the first end, a sleeve including an adjustable portion for receiving a fillable material therein; and a slit on a surface of the sleeve;

filling the adjustable portion with the fillable material through the slit;

twisting the adjustable portion relative to a portion of the sleeve that includes the slit about a folding point; and inserting at least a portion of the adjustable portion through the slit.

16. The method of claim 15, wherein the bra insert further includes a flap, and the method further includes:

positioning the flap between an underside of the bra and skin of the user, therefore securing the bra insert under the bra.

17. The method of claim 15, wherein the slit is adjacent to one of the first and second ends, and the adjustable portion is adjacent to the other one of the first and second ends.

18. The method of claim 15, further comprising adjusting an amount of the fillable material received in the adjustable portion to conform a shape of the bra insert to a shape of the bra of the user.

19. The method of claim 15, wherein the inserting further includes inserting at least a portion of an outer surface of the adjustable portion through the slit such that the portion of the outer surface of the adjustable portion abuts one of the first and second ends proximate the slit.

20. A bra insert comprising:

a first end;

a second end opposite the first end;

a sleeve configured to extend between the first end and the second end along a longitudinal axis, the sleeve including an adjustable portion for receiving a fillable material therein; and a slit on an outer surface of the sleeve, the slit sized to receive at least a portion of the adjustable portion therethrough, wherein the adjustable portion is configured to be in a wearable form in which at least a portion of an outer surface of the adjustable portion is inserted through the slit and abuts one of the first and second ends proximate the slit.

* * * * *